US007143448B1

(12) United States Patent
Gottehrer

(10) Patent No.: US 7,143,448 B1
(45) Date of Patent: Dec. 5, 2006

(54) BIB FOR CATCHING WASTE

(76) Inventor: Jonathan M. Gottehrer, 198 Dartmouth Dr., 2nd Floor, Hicksville, NY (US) 11801

( * ) Notice: Subject to any disclaimer, the term of this patent is extended or adjusted under 35 U.S.C. 154(b) by 0 days.

(21) Appl. No.: 11/388,143

(22) Filed: Mar. 24, 2006

(51) Int. Cl.
*A41B 13/10* (2006.01)

(52) U.S. Cl. ..... 2/49.2; 2/52

(58) Field of Classification Search ..... 2/49.1, 2/49.2, 52, 49.3, 49.4, 49.5, 48, 51, 50, 75, 2/46; D2/860–864; 24/442, 452, 584.1, 24/585.11

See application file for complete search history.

(56) References Cited

U.S. PATENT DOCUMENTS 632,863 A * 9/1899 Blank ..... 2/49.2
D61,023 S 5/1922 Waters ..... D2/864
D104,490 S * 5/1937 Anderson ..... D2/864
D152,879 S * 3/1949 Grassi ..... D2/864
2,479,154 A * 8/1949 Cantor ..... 2/48
D161,608 S 1/1951 Arseneault ..... D2/861
2,552,462 A 5/1951 Savrin
2,629,870 A * 2/1953 Hudson ..... 2/49.1
2,697,222 A * 12/1954 Reid ..... 2/49.2
2,835,695 A 5/1958 Wells ..... 2/49.1
3,010,111 A 11/1961 Ralph
D206,425 S * 12/1966 Faughnder ..... D2/864
D216,291 S * 12/1969 Korshak ..... D2/864
3,583,558 A 6/1971 Davis ..... 242/160.1
3,597,763 A * 8/1971 Bienvenu ..... 2/49.3
3,851,336 A * 12/1974 Hjerl ..... 2/49.3
4,233,688 A * 11/1980 Hjerl ..... 2/49.2
4,860,381 A * 8/1989 Bartley ..... 2/49.3
4,946,527 A * 8/1990 Battrell ..... 24/306
5,530,968 A * 7/1996 Crockett ..... 2/46
5,918,311 A 7/1999 Lampson et al.
6,058,506 A 5/2000 Reinhart, Jr.
6,105,165 A 8/2000 Johnson et al.
6,128,780 A 10/2000 Reinhart, Jr.
6,237,150 B1 5/2001 Lucas
6,381,751 B1 5/2002 Benjamin et al.
6,481,016 B1 * 11/2002 Rees ..... 2/49.1
6,490,731 B1 12/2002 Hyatt ..... 2/49.1
6,499,140 B1 12/2002 Benjamin et al.
D483,552 S * 12/2003 Hughes ..... D2/861
D493,024 S * 7/2004 Bergkvist ..... D2/864
6,789,265 B1 * 9/2004 Vonrinteln ..... 2/49.2
2006/0000002 A1 1/2006 Bergkvist ..... 2/49.1

FOREIGN PATENT DOCUMENTS

FR 2677226 A1 12/1992
JP 2005068619 A 3/2005

OTHER PUBLICATIONS

Tommee Tippee.www.tommeetippee.co.uk/shop/. Date viewed: Jul. 2006. Comfi-Neck Catch All Bibs. Item A: Center of Page.
The Baby Bib Store. www.baby.bib.com/babjbi3.html. Mar. 2005. Baby Bjorn Bib. Item B: Center of Page.

* cited by examiner

*Primary Examiner*—A. Vanatta
(74) *Attorney, Agent, or Firm*—Richard L. Miller

(57) ABSTRACT

A bib for catching waste, food and/or liquids which comprises a panel sized to cover and protect the chest of a person. A structure on an upper portion of the panel is for suspending the panel from a neck of a person. A bowl is integrally formed onto a lower portion of the panel, wherein the bowl will catch the food and liquids that spill onto the panel.

1 Claim, 1 Drawing Sheet

BIB FOR CATCHING WASTE

BACKGROUND OF THE INVENTION

1. Field of the Invention

The present invention relates to a bib, and more particularly, a bib for catching waste which is often foods and/or liquids.

2. Description of the Prior Art

Numerous innovations for bibs have been provided in the prior art that will be described. Even though these innovations may be suitable for the specific individual purposes to which they address, however, they differ from the present invention.

A FIRST EXAMPLE, U.S. Pat. No. 2,552,462, Issued on May 8, 1951, to Savrin teaches a bib for an infant which includes an upper body and garment covering portion having a cut out section to accommodate the neck of the infant, a pocket formed on the front and upper part of the body portion with a quasi-V-shaped recess at the front and upper part of the pocket, an insert comprising a blank of absorbent material, one part of which is insertable into and held by the lower part of the pocket, over the cut out section and means at the rear of the body portion of the bib to hold another part of the insert against the rear of the bib, whereby the insert is interposed between the neck of the infant and the bib.

A SECOND EXAMPLE, U.S. Pat. No. 3,010,111, Issued on Nov. 28, 1961, to Ralph teaches a bib of flexible sheet material having an upper breast sheet portion, a horizontally transverse elongated bib pocket at the lower portion of the breast sheet, the pocket having a front wall of flexible sheet material overlying a lower portion of one face of the breast sheet providing relatively overlying opposed flexible front and rear walls connected at the bottom of the pocket, the pocket having its opposite ends and a lower longitudinal edge securely closed and being open at its opposite upper longitudinal edge portion, the upper free edge of the front wall being freely flexible, and angularly bent strips of pliant inert material spaced from the opposite ends of the pocket and spaced relative to each other, each of the strips having legs which respectively engage the front and rear walls of the bib pocket laterally transversely of the length of the elongated pocket and extending from the bottom of the bib pocket towards the upper edge portion thereof and terminating adjacent to the upper open edge portion of the pocket, the pliant strips of bendable material being inherently form-retaining when bent, whereby the pocket opening may be selectively held at open and closed positions responsive to the selective bending of the strips, the breast sheet and pocket portions being freely flexible throughout the area thereof other than the area occupied by the pliant strips, whereby the freely flexible portion may be manipulated to selective shapes and forms around the pliant strips.

A THIRD EXAMPLE, U.S. Pat. No. 5,918,311, Issued on Jul. 6, 1999, to Lampson et al. teaches a bib having an improved pocket opening. The pocket is formed by a pocket panel disposed adjacent a body panel. A pocket opening mechanism in combination with a predetermined hinge line sustain the pocket opening. The pocket opening mechanism can comprise an elastic member, and the predetermined hinge can be provided by a crease formed by folding. In one embodiment, the bib includes an apron panel for facilitating gravitational opening of the pocket. The apron can comprise a longitudinally extending crease. The creases in each panel can extend generally parallel to a longitudinal centerline of the bib.

A FOURTH EXAMPLE, U.S. Pat. No. 6,058,506, Issued on May 9, 2000, to Reinhart, Jr. teaches a bib having an improved pocket. The pocket is formed by a pocket panel disposed adjacent a body panel. A longitudinally extending crease is disposed in at least one of the pocket panel and the body panel. In one embodiment, the bib includes an apron panel for facilitating gravitational opening of the pocket. The apron can comprise a longitudinally extending crease. The creases in each panel can extend generally parallel to a longitudinal centerline of the bib.

A FIFTH EXAMPLE, U.S. Pat. No. 6,105,165, Issued on Aug. 22, 2000, to Johnson et al. teaches a collapsible, pop-out bib that includes a lower bowl section to catch food or beverage spills. The lower bowl section comprises a guide sewn into an upper edge, the guide is created by either a simple fold in the web material's fabric, or by attaching a fabric tape or bias tape to the upper edge of the lower bowl section and continues around the entire perimeter of the lower bowl section's upper edge. The bib also comprises an elongated flexible spring material that is inserted into the upper edge guide to continue around the entire perimeter of the lower bowl section's upper edge. The spring material comprises a male/female connector on opposing ends that enable the ends to be fastened together to form a large single-looped configuration, thereby creating tension on the periphery of the upper edge of the bowl, which holds the bowl out and open to catch spills. The bib is reversibly collapsible by twisting the spring material out of it's plane to form an odd numbered multi-looped configuration, resulting in a relatively small and convenient storage size.

A SIXTH EXAMPLE, U.S. Pat. No. 6,128,780, Issued on Oct. 10, 2000, to Reinhart, Jr. teaches a bib having an improved pocket. The bib has a body panel, a pocket panel, and a third panel disposed between the body panel and the pocket panel. The third panel helps to maintain the pocket in an open configuration.

A SEVENTH EXAMPLE, U.S. Pat. No. 6,237,150 B1, Issued on May 29, 2001, to Lucas teaches a disposable bib for catching food and liquids while feeding an infant or toddler. The disposable bib includes a panel. The panel has a bottom edge, a top edge, and a pair of side edges. The panel has a top layer, a middle layer and a bottom layer. The top layer comprises a relatively porous material, the middle layer comprises a relatively absorbent material, and the bottom layer comprises a relatively non-porous material. The panel has an opening therein positioned generally adjacent to the top edge.

AN EIGHTH EXAMPLE, U.S. Pat. No. 6,381,751 B1, Issued on May 7, 2002, to Benjamin et al. teaches a bib having an improved pocket. The bib has a body panel, a pocket panel forming a pocket space between the body panel and the pocket panel, and a third panel joined to the pocket panel. The third panel includes a flexible member joined thereto that helps to maintain the pocket space in an open configuration once the third panel is folded into the pocket space.

A NINTH EXAMPLE, U.S. Pat. No. 6,499,140 B1, Issued on Dec. 31, 2002, to Benjamin et al. teaches a bib having an improved pocket. The bib has a body panel, a pocket panel forming a pocket space between the body panel and the pocket panel, and a third panel joined to the pocket panel. The third panel includes a flexible member joined thereto that helps to maintain the pocket space in an open configuration once the third panel is folded into the pocket space.

It is apparent now that numerous innovations for bibs have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a bib for catching waste, food and liquids that avoids the disadvantages of the prior art.

ANOTHER OBJECT of the present invention is to provide a bib for catching waste, food and liquids that is simple and inexpensive to manufacture.

STILL ANOTHER OBJECT of the present invention is to provide a bib for catching waste, food and liquids that is simple to use.

BRIEFLY STATED, STILL YET ANOTHER OBJECT of the present invention is to provide a bib for catching waste, food and liquids which comprises a panel sized to cover and protect the chest of a person. A structure on an upper portion of the panel is for suspending the panel from a neck of a person. A bowl is integrally formed onto a lower portion of the panel, wherein, the bowl will catch the food and liquids that spill onto the panel.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALLING OF REFERENCE NUMERALS UTILIZED IN THE DRAWING

Figure 1:
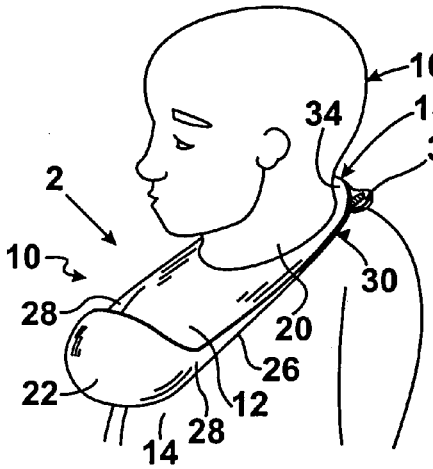
FIG. 1 is a diagrammatic perspective view showing the present invention in use on a person.

10 bib
12 panel of bib 10
14 chest of person 16
16 person
18 suspending structure of bib 10
20 neck of person 16
22 bowl of bib 10
24 semirigid waterproof material (rubber) of bib 10
26 ovoid shaped circumference of panel 12
28 tapered side projection of bowl 22
30 flap extension of suspending structure 18
32 opening in panel 12
34 closure tab of flap extension 30
36 intermeshing mushroom shaped element on closure tab 34
38 finger grip on closure tab 34

DETAILED DESCRIPTION OF THE PREFERRED EMBODIMENT

Figure 2:
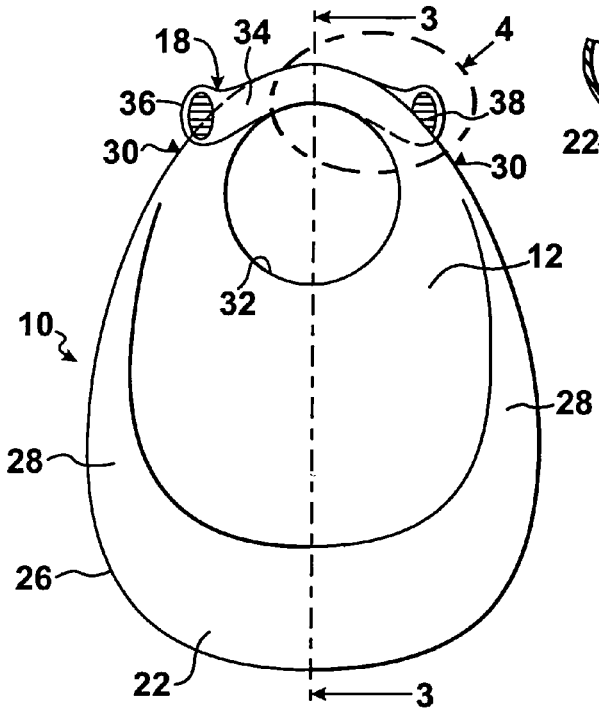
FIG. 2 is a diagrammatic front elevational view of the present invention per se taken generally in the direction of arrow 2 in FIG. 1.

Referring now to the figures, in which like numerals indicate like parts, and particularly to FIGS. 1, 2 and 3, which are a diagrammatic perspective view showing the present invention in use on a person; a diagrammatic front elevational view of the present invention per se taken generally in the direction of arrow 2 in FIG. 1; and a cross sectional view taken on line 3—3 of FIG. 2, and as such, will be discussed with reference thereto.

The present invention is a bib 10 for catching waste, food and liquids which comprises a panel 12 sized to cover and protect the chest 14 of a person 16. A structure 18 on an upper portion of the panel 12 is for suspending the panel 12 from a neck 20 of the person 16. A bowl 22 is integrally formed onto a lower portion of the panel 12, wherein the bowl 22 will catch the waste, food and liquids that spill onto the panel 12.

Figure 3:
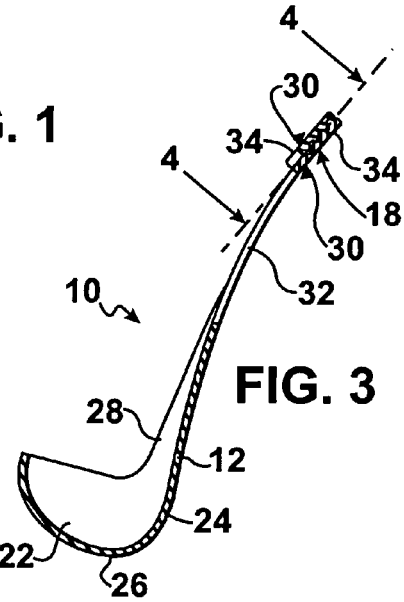
FIG. 3 is a cross sectional view taken on line 3—3 of FIG. 2.

The bib 10 is fabricated out of a semirigid waterproof material, wherein the semirigid waterproof material is rubber 24 (see FIG. 3). The panel 12 includes a generally ovoid shaped circumference 26 thereabout. The bowl 22 is a generally U-shaped configuration having a pair of tapered side projections 28 that extend on the ovoid shaped circumference 26 of the panel 12, up to the suspending structure 18. The pair of tapered side projections 28 of the U-shaped bowl 22 will further help catch the waste and/or food and liquids that spill onto panel 12.

Figure 4:
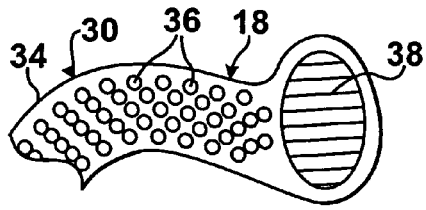
FIG. 4 is an enlarged diagrammatic elevational view, with parts broken away, of the rear closure tab per se, taken on line 4—4 of FIG. 3, and also shown enclosed in the dotted curve indicated by arrow 4 in FIG. 2.

FIG. 4 is an enlarged diagrammatic elevational view, with parts broken away, of the rear closure tab per se, shown enclosed in the dotted curve indicated by arrow 4 in FIG. 2, and as such, will be discussed with reference thereto.

The suspending structure 18 of the bib 10 consists of a pair of curved overlapping interlocking flap extensions 30, which form an opening 32 to receive the neck 20 of the person 16. Each flap extension 30 includes a closure tab 34. A plurality of intermeshing mushroom shaped elements 36 are formed on the closure tab 34. A finger grip 38 is formed on a free end of the closure tab 34. The mushroom shaped elements 36 are similar to those described in U.S. Pat. No. 3,471,903 to Northrup et al for a STUD-BACK FASTENER which are referred to as either head elements 2 or mushroom shaped elements 9 and 10.

It will be understood that each of the elements described above, or two or more together, may also find a useful application in other types of constructions differing from the types described above.

While the invention has been illustrated and described as embodiments of a bib for catching waste, food and liquids, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A bib for catching waste, food and liquids which comprises:

a) a panel sized to cover and protect the chest of a person;

b) means on an upper portion of said panel for suspending said panel from a neck of the person; and c) a bowl integrally formed onto a lower portion of said panel, wherein said bowl will catch the waste, food and liquids that spill onto said panel, wherein said bib is fabricated out of a semirigid waterproof material, wherein said semirigid waterproof material is rubber, wherein said panel includes a generally ovoid shaped circumference thereabout, wherein said bowl is in a generally U-shaped configuration having a pair of tapered side projections that extend on said ovoid shaped circumference of said panel, up to said suspending means, wherein said pair of tapered side projections of said U-shaped bowl will further help catch the waste, food and liquids that spill onto said panel, wherein said suspending means includes a pair of curved overlapping interlocking flap extensions, which form an opening to receive the neck of the person, wherein each said flap extension includes:

i) a closure tab;

ii) a plurality of intermeshing mushroom shaped elements formed on said closure tab; and iii) a finger grip formed on a free end of said closure tab.

* * * * *